US009193193B2

(12) United States Patent
Balsells Mercadé et al.

(10) Patent No.: US 9,193,193 B2
(45) Date of Patent: Nov. 24, 2015

(54) TRANSMISSION DEVICE FOR PLOTTERS

(75) Inventors: Antoni Balsells Mercadé, Key Biscayne, FL (US); Francesc Masgrau Lagresa, Banyoles (ES); Antoni Guimerà Pedrola, Sant Sadurni D'anoia (ES)

(73) Assignee: TKT BRAINPOWER, S.L., Barcelona (ES)

( * ) Notice: Subject to any disclaimer, the term of this patent is extended or adjusted under 35 U.S.C. 154(b) by 0 days.

(21) Appl. No.: 13/577,552

(22) PCT Filed: Feb. 8, 2011

(86) PCT No.: PCT/ES2011/070083

§ 371 (c)(1),
(2), (4) Date: Sep. 20, 2012

(87) PCT Pub. No.: WO2011/098647

PCT Pub. Date: Aug. 18, 2011

(65) Prior Publication Data

US 2013/0032658 A1 Feb. 7, 2013

(30) Foreign Application Priority Data

Feb. 9, 2010 (ES) ..... 201030177

(51) Int. Cl.
*B65H 18/14* (2006.01)
*B65H 18/26* (2006.01)
(Continued)

(52) U.S. Cl.
CPC *B41J 23/02* (2013.01); *B41J 17/02* (2013.01); *B65H 18/26* (2013.01)

(58) Field of Classification Search
CPC ..... B65H 18/20; B65H 18/16; G11B 15/295
USPC ..... 242/541, 541.4, 541.5, 390, 390.8
See application file for complete search history.

(56) References Cited

U.S. PATENT DOCUMENTS 668,754 A * 2/1901 Koegel ..... 242/422.8
2,059,871 A * 11/1936 Honeyman, Jr. ..... 68/180
(Continued)

FOREIGN PATENT DOCUMENTS

ES 2 326 102 A1 9/2009
JP 60-240486 A 11/1985
(Continued)

OTHER PUBLICATIONS

International Search Report issued by the International Searching Authority (ISA/O.E.P.M.) on Jan. 6, 2011 in connection with International Application No. PCT/SE2011/070083.

*Primary Examiner* — Emmanuel M Marcelo
*Assistant Examiner* — Michael Gallion
(74) *Attorney, Agent, or Firm* — Gary J. Gershik

(57) ABSTRACT

The present invention relates to transmission device for plotters characterized in that it comprises at least a freely rotating first wheel (2) arranged between the motor tube (5) and the winder tube (6) of a plotter, such that the rotation of the motor tube (5) is transmitted to said winder tube (6) through said freely rotating first wheel (2). It may also comprise a pair of freely rotating wheels (3) that are constrained to rotate together by contact, arranged between said motor tube (5) and said winder tube (6), one wheel of said pair of wheels (3) being in contact with said motor tube (5) and the other wheel of said pair of wheels (3) being in contact with said winder tube (6). It facilitates the change from direct to inverse transmission without having to use tools, and it achieves a clutch effect as the result of the sliding of the wheels with respect to the tubes.

6 Claims, 4 Drawing Sheets

(51) Int. Cl.
*B41J 23/02* (2006.01)
*B41J 17/02* (2006.01)

(56) References Cited

U.S. PATENT DOCUMENTS

| | | | | | |
|---|---|---|---|---|---|
| 3,312,408 | A | * | 4/1967 | Owens | 242/542.3 |
| 3,370,804 | A | * | 2/1968 | Peyton | 242/352.3 |
| 4,049,095 | A | * | 9/1977 | Montalvo, Sr. | 192/3.51 |
| 4,196,872 | A | * | 4/1980 | Vogel | 242/352.3 |
| 4,226,386 | A | * | 10/1980 | Rubi | 242/352.3 |
| 4,262,859 | A | * | 4/1981 | Yamanaka | 242/352.3 |
| 4,465,247 | A | * | 8/1984 | Gliniorz et al. | 242/352.3 |
| 4,498,274 | A | * | 2/1985 | Vorhauer | 53/412 |
| 4,589,604 | A | * | 5/1986 | Yagi et al. | 242/356 |
| 4,877,196 | A | * | 10/1989 | Heymanns | 242/541.5 |
| 5,174,515 | A | * | 12/1992 | Meier | 242/388 |
| 5,749,038 | A | * | 5/1998 | Fromm et al. | 399/327 |
| 5,888,084 | A | * | 3/1999 | Mukai et al. | 439/164 |
| 6,062,507 | A | * | 5/2000 | Summey, III | 242/541 |
| 6,325,321 | B1 | * | 12/2001 | Maurer et al. | 242/534 |
| 6,486,904 | B1 | * | 11/2002 | Onozato et al. | 347/213 |
| 6,715,709 | B2 | * | 4/2004 | Stephens et al. | 242/533 |
| 6,752,346 | B2 | * | 6/2004 | Meyer et al. | 242/533 |
| 7,309,178 | B2 | * | 12/2007 | Ikeda | 400/232 |
| 7,905,441 | B2 | * | 3/2011 | Scherzinger et al. | 242/374 |
| 8,064,813 | B2 | * | 11/2011 | Fromm et al. | 399/327 |
| 2010/0237181 | A1 | * | 9/2010 | Andersson et al. | 242/559.2 |

FOREIGN PATENT DOCUMENTS

| | | | |
|---|---|---|---|
| JP | 61-287646 | A | 12/1986 |
| JP | 10-08165 | A | 1/1989 |
| JP | 7-148952 | A | 6/1995 |
| JP | 2002-310260 | A | 10/2002 |
| JP | 2006-015865 | A | 1/2006 |

* cited by examiner

TRANSMISSION DEVICE FOR PLOTTERS

RELATED APPLICATIONS

This application is a §371 national stage of PCT International Application No. PCT/ES2011/070083, filed Feb. 8, 2011, claiming priority of Spanish Patent Application No. P201030177, filed Feb. 9, 2010, the contents of each of which are hereby incorporated by reference into this application.

The present invention relates to a transmission device for plotters, particularly for synchronizing the rotation of the motor tube feeding the sheet material to be printed with the rotation of the winder tube, on which the printed sheet material is wound, such that the tangential velocity of the uppermost layer of the reel of printed sheet material is equal to the tangential velocity of the motor tube.

BACKGROUND OF THE INVENTION

In plotters, the motor tube feeding the sheet material to be printed and the winder tube where the already printed sheet material is wound must be synchronized to achieve the correct winding of the printed sheet material.

Today said synchronization is achieved by means of complicated and costly transmission mechanisms which are provided with sensors and motors.

Another drawback of the transmission mechanisms know today is that its direct or inverse transmission and change is complicated or impossible.

Therefore, there is an obvious need for a transmission device synchronizing the motor tube and the winder tube, which is simple and economical, can be used indiscriminately for the direct and inverse transmission thereof, and takes the amount of sheet material present in the winder tube into account for regulating the rotation speed of both tubes.

DESCRIPTION OF THE INVENTION

The transmission device of the invention successfully solves the mentioned drawbacks, having other advantages which will be described below.

The transmission device for plotters of the present invention is characterized in that it comprises at least a freely rotating first wheel arranged between the motor tube and the winder tube of a plotter, such that the rotation of the motor tube is transmitted to said winder tube through said freely rotating first wheel.

Advantageously, the transmission device of the present invention also comprises a pair of freely rotating wheels that are constrained to rotate together by contact, arranged between said motor tube and said winder tube, one wheel of said pair of wheels being in contact with said motor tube and the other wheel of said pair of wheels being in contact with said winder tube.

According to a preferred embodiment, said first wheel is arranged at one end of said transmission device and said pair of wheels is arranged at the other end of said transmission device.

Furthermore, the transmission device according to the present invention also comprises a pair of shafts located at the ends of the transmission device, in the opposite part with respect to said wheels for the assembly thereof as direct transmission or inverse transmission.

The transmission device of the present invention successfully achieves the following advantages:

- ease of inserting and removing the winder tube since it simply rests on the transmission device of the present invention;
- ease of changing from direct to inverse transmission without having to use tools;
- a clutch effect is achieved as a result of the sliding of the wheels with respect to the tubes.

DETAILED DESCRIPTION OF THE DRAWINGS

To better understand the foregoing, several drawings are attached in which a practical case of embodiment is schematically depicted only by way of non-limiting example.

DESCRIPTION OF A PREFERRED EMBODIMENT

Figure 1:
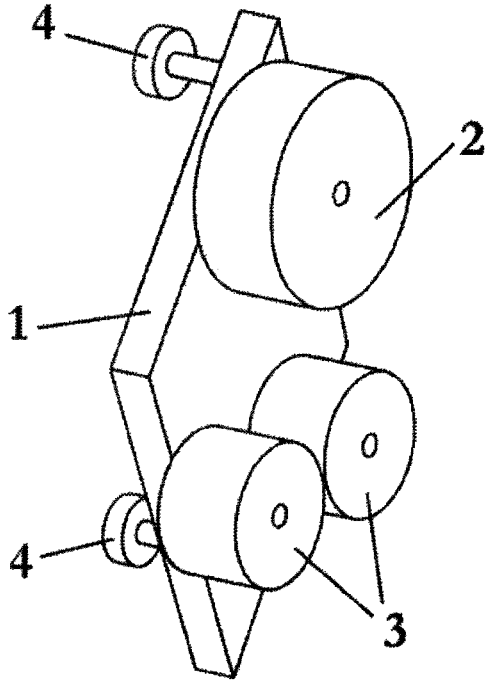
FIG. 1 is a schematic perspective view of the transmission device of the present invention.

As can be seen in FIG. 1, the transmission device of the present invention is formed by a plate 1, preferably a rhombus-shaped plate, in which there are assembled: a first wheel 2 located close to one of its ends and a pair of wheels 3 located close to the other end.

Said plate 1 also comprises, in its part contrary to the wheels, a pair of shafts 4 for the assembly thereof in the plotter, as will be described below.

Figure 2:
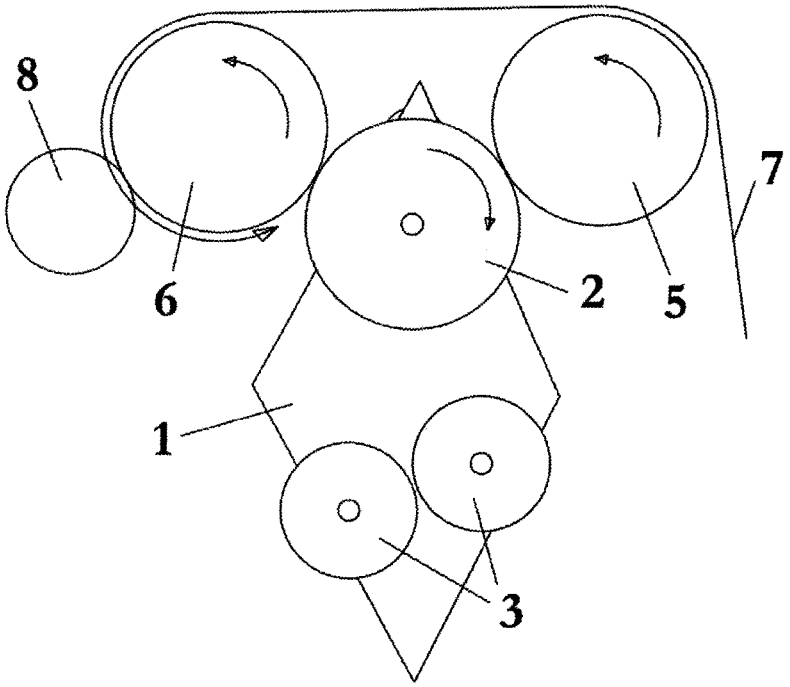
FIG. 2 is a schematic front elevational view of the transmission device of the present invention located between the motor tube and the winder tube in the position of direct rotation thereof.

The first wheel 2 is used for the direct transmission between the motor tube 5 and the winder tube 6, such that said freely rotating first wheel 2 is placed between both tubes 5, 6, as better seen in FIG. 2. For greater clarity the directions of rotation of each of the components have been indicated in this FIG. 2 with arrows.

Figure 3:
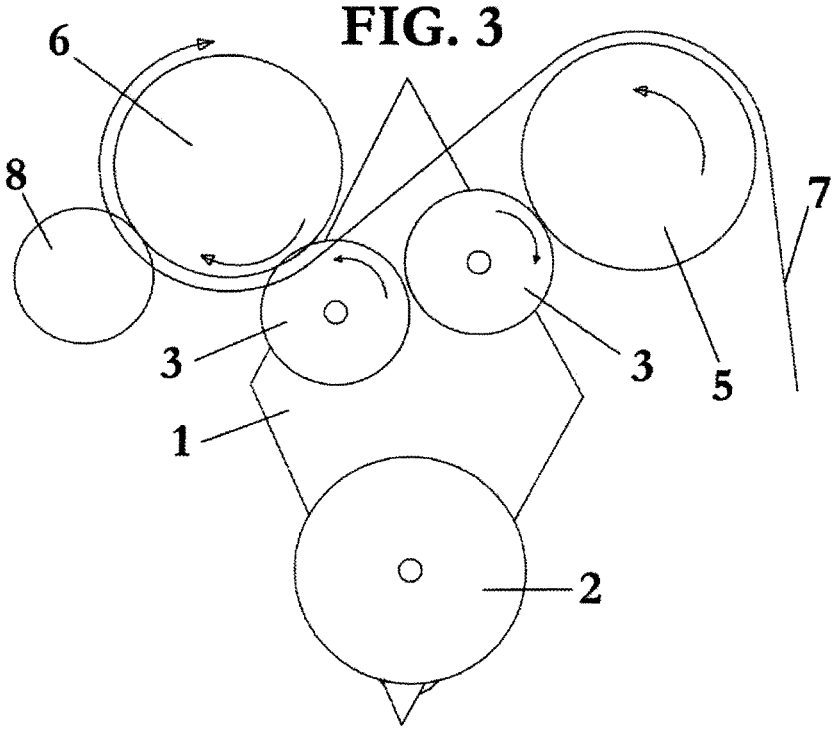
FIG. 3 is a schematic front elevational view of the transmission device of the present invention located between the motor tube and the winder tube in the position of inverse rotation thereof.

The pair of wheels 3 is in turn used for the inverse transmission between the motor tube 5 and the winder tube 6. To that end, the wheels of the pair of wheels 3 rotate freely and are constrained to rotate by contact, i.e., when one rotates the other rotates in an opposite direction. For greater clarity the directions of rotation of each of the components have been indicated in this FIG. 3 with arrows.

As indicated above, said motor tube 5 feeds the sheet material 7 to be printed, whereas the already printed sheet material 7 is wound on the winder tube 6.

It must be pointed out that the drawings depicted an additional wheel 8 supporting the winder tube 6. The rest of the components of the plotter have not been depicted for the sake of simplicity.

Figure 4:
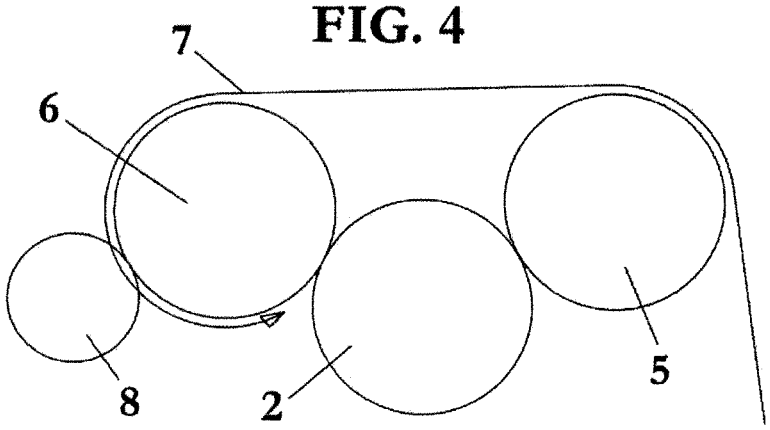
FIG. 4 is a schematic view of the transmission device of the present invention shown at the start of the sheet material winding operation.

As depicted in FIG. 4, when the winding of the sheet material 7 on the winder tube 6 starts, the diameter of the winder tube with the sheet material 7 is substantially equal to the diameter of the motor tube 5, such that their rotation speeds are equal.

Figure 5:
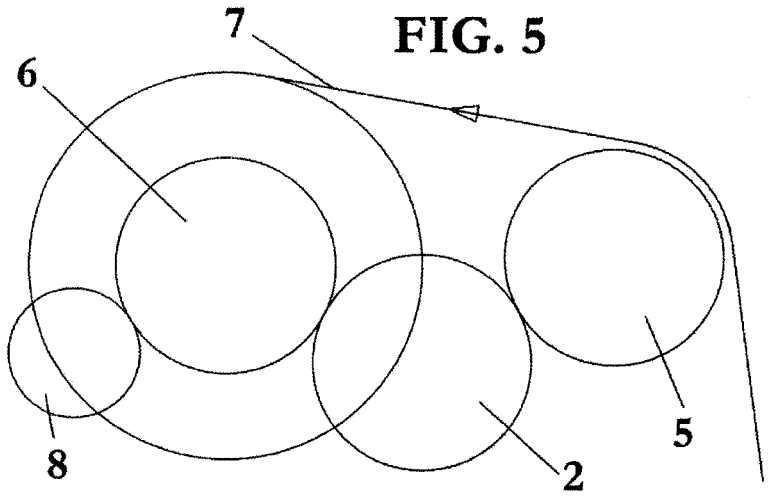
FIG. 5 is a schematic view of the transmission device of the present invention shown when a large amount of sheet material has been wound.

However, as depicted in FIG. 5, as the sheet material 7 is gradually wound on the winder tube 6, the diameter defined by said sheet material 7 plus the diameter of the winder tube 6 increases and, therefore, the rotation speed of said assembly must be less than the rotation speed of the motor tube 5. To that end, according to the invention, the speed decreases due to the relative sliding between the first wheel 2 (or the pair of wheels 3) and the motor tube 5 and the winder tube 6, which allows these different speeds.

To change from direct transmission to inverse transmission, or vice versa, it is only necessary to remove the transmission device of the present invention, invert it and reassemble it, as a result of the presence of said shafts 4.

Despite that reference has been made to a specific embodiment of the invention, it is obvious for a person skilled in the art that the transmission device described is susceptible to various variations and modifications, and that all the details mentioned can be substituted with other technically equivalent details without departing from the scope of protection defined by the claims attached.

The invention claimed is:

1. A transmission device for plotters comprising a single freely rotating first wheel (2) arranged to simultaneously contact the motor tube (5) and the winder tube (6) of a plotter, such that the rotation of the motor tube (5) is transmitted to said winder tube (6) through only said freely rotating first wheel (2), wherein the single freely rotating first wheel (2) is unconnected to a motor other than the motor tube, and capable of being rotated clockwise or counterclockwise; and, wherein the freely rotating first wheel (2) slides relative to motor tube (5) or winder tube (6) when the winder tube (6) has a different rotational speed than the motor tube (5).

2. The transmission device according to claim 1, further comprising a pair of freely rotating wheels (3) that are constrained to rotate together by contact, arranged between said motor tube (5) and said winder tube (6), one wheel of said pair of wheels (3) being in contact with said motor tube (5) and the other wheel of said pair of wheels (3) being in contact with said winder tube (6).

3. The transmission device according to claim 1, wherein said first wheel (3) is arranged at one end of said transmission device, and said pair of wheels (3) are arranged to the other end of said transmission device.

4. The transmission device according to claim 3, comprising a pair of shafts (4) located at the ends of the transmission device on a side of a plate (1) which is opposite said wheels (2, 3) are located for direct transmission or inverse transmission.

5. The transmission device according to claim 2, wherein said first wheel (2) is arranged at one end of said transmission device, and said pair of wheels (3) are arranged at the other end of said transmission device.

6. The transmission device according to claim 5, comprising a pair of shafts (4) located at the ends of the transmission device on a side of a plate (1) which is opposite to a side of the plate (1) where said wheels (2, 3) are located for direct transmission or inverse transmission.

* * * * *